US009646442B2

(12) United States Patent
Chan et al.

(10) Patent No.: US 9,646,442 B2
(45) Date of Patent: May 9, 2017

(54) ELECTRONIC LOCK AND METHOD FOR WIRELESSLY UNLOCKING THE ELECTRONIC LOCK

(71) Applicant: HON HAI PRECISION INDUSTRY CO., LTD., New Taipei (TW)

(72) Inventors: Chuan-Te Chan, New Taipei (TW); Wen-Chia Lee, New Taipei (TW); Sheng-Feng Weng, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/804,680

(22) Filed: Jul. 21, 2015

(65) Prior Publication Data

US 2016/0104333 A1 Apr. 14, 2016

(30) Foreign Application Priority Data

Oct. 8, 2014 (TW) ..... 103134964 A

(51) Int. Cl.
*G07C 9/00* (2006.01)

(52) U.S. Cl.
CPC ..... *G07C 9/00309* (2013.01)

(58) Field of Classification Search
CPC combination set(s) only.
See application file for complete search history.

(56) References Cited

U.S. PATENT DOCUMENTS

2011/0088086 A1* 4/2011 Swink ..... G06F 3/04883 726/7
2013/0057496 A1* 3/2013 Hong ..... G06F 3/0488 345/173

FOREIGN PATENT DOCUMENTS

CN 101770659 A 7/2010
CN 102168509 B 8/2011
TW 201003453 A 1/2010

* cited by examiner

*Primary Examiner* — Kabir A Timory
(74) *Attorney, Agent, or Firm* — Steven Reiss

(57) ABSTRACT

A method for unlocking an electronic lock includes receiving a password transmitted from an electronic device, and determining whether the received password matches a preset password, the preset password is a certain movement of one or more electronic devices. If the received password matches the preset password, determining whether the electronic lock is operating in a temporary pass state or in a non-temporary pass state. The electronic lock is unlocked if the electronic lock is operating in the temporary pass state, but further user verifications are required if the electronic lock is operating in the non-temporary pass state.

14 Claims, 2 Drawing Sheets

ELECTRONIC LOCK AND METHOD FOR WIRELESSLY UNLOCKING THE ELECTRONIC LOCK

CROSS-REFERENCE TO RELATED APPLICATIONS

This application claims priority to Taiwanese Patent Application No. 103134964 filed on Oct. 8, 2014, the contents of which are incorporated by reference herein.

FIELD

The subject matter herein generally relates to electronic security.

BACKGROUND

Security systems are designed to prevent access by unauthorized personnel. However, magnetic induction is a common way for unlocking electronic locks.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
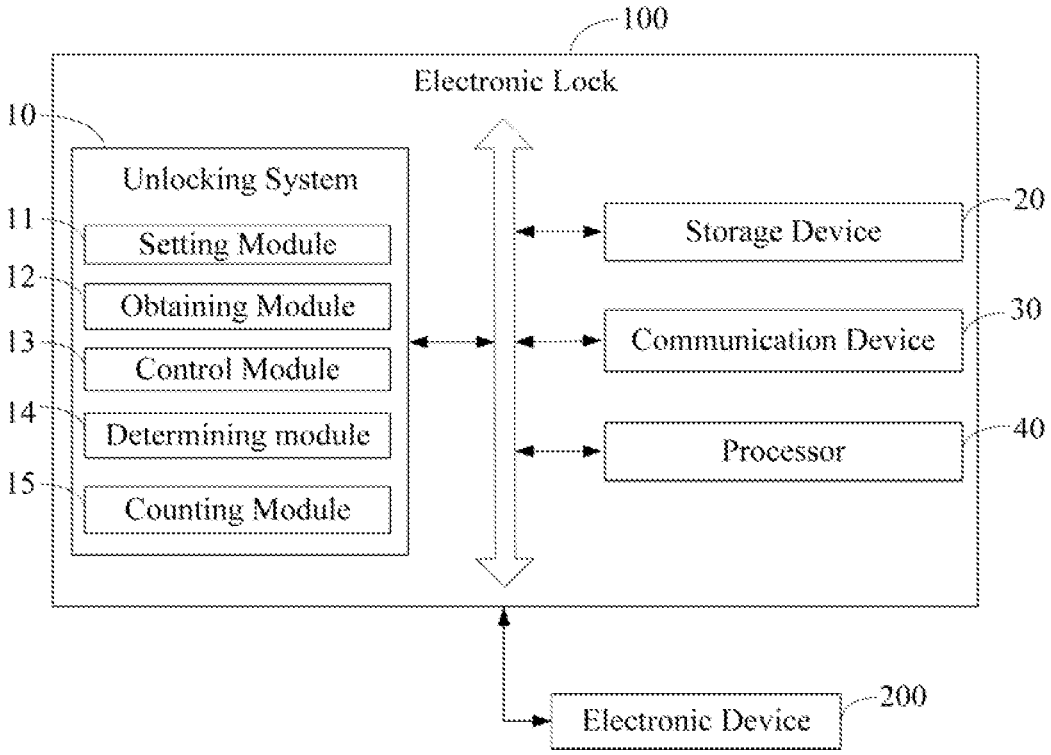
FIG. 1 is a block diagram of one embodiment of an electronic lock including an unlocking system.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in details so as not to be considered as limiting the scope of the embodiments described herein. The drawings are not necessarily to scale and the proportions of certain parts may be exaggerated to better illustrate details and features of the present disclosure.

The present disclosure, including the accompanying drawings, is illustrated by way of examples and not by way of limitation. Several definitions that apply throughout this disclosure will now be presented. It should be noted that references to "an" or "one" embodiment in this disclosure are not necessarily to the same embodiment, and such references mean "at least one".

Furthermore, the term "module", as used herein, refers to logic embodied in hardware or firmware, or to a collection of software instructions, written in a programming language, such as Java, C, or assembly. One or more software instructions in the modules can be embedded in firmware, such as in an EPROM. The modules described herein can be implemented as either software and/or hardware modules and can be stored in any type of non-transitory computer-readable medium or other storage device. Some non-limiting examples of non-transitory computer-readable media includes CDs, DVDs, BLU-RAY, flash memory, and hard disk drives. The term "comprising" means "including, but not necessarily limited to"; it specifically indicates open-ended inclusion or membership in a so-described combination, group, series and the like.

FIG. 1 illustrates one embodiment of an electronic lock. In at least one embodiment as shown in FIG. 1, an electronic lock 100 includes, but is not limited to, an unlocking system 10, a storage device 20, a communication device 30, and at least one processor 40. FIG. 1 illustrates only one example of the electronic lock 100, other examples can include more or fewer components than illustrated, or have a different configuration of the various components in other embodiments.

In at least one embodiment, the storage device 20 can include various types of non-transitory computer-readable storage mediums. For example, the storage device 20 can be an internal storage system, such as a flash memory, a random access memory (RAM) for temporary storage of information, and/or a read-only memory (ROM) for permanent storage of information. The storage device 20 can also be an external system, such as a hard disk, a storage card, or a data storage medium.

The communication device 30 can wirelessly communicate with an electronic device 200. In some embodiments, the communication device 30 can be WIFI device. In other embodiments, the communication device 30 can be BLUETOOTH device. The electronic device 200 can include wireless communication device. The electronic device 200 can be a tablet computer, a notebook computer, a smart phone, a personal digital assistant (PDA), or other suitable electronic device.

The at least one processor 40 can be a central processing unit (CPU), a microprocessor, or other data processor chip that performs functions of the unlocking system 10 in the electronic lock 100.

The unlocking system 10 can unlock the electronic lock 100 after receiving a correct password transmitted from the electronic device 200.

In at least one embodiment, the unlocking system 10 can include a setting module 11, an obtaining module 12, a determining module 13, a control module 14, and a counting module 15. The function modules 11-15 can include computerized codes in the form of one or more programs, which are stored in the storage device 20. The at least one processor 40 executes the computerized codes to provide functions of the function modules 11-15.

The setting module 11 provides a user interface for a manager of the electronic lock 100 to preset a password, current state information for the electronic lock 100, and privilege information of the electronic lock 100, to be stored in the storage device 20.

The preset password can be digital password or a certain movement of the electronic device 200. In at least one embodiment, the electronic device 200 includes an electronic gyroscope, and the preset password may be defined according to the acceleration range or the angle range of a certain movement of the electronic device 200, as experienced in three axes of the electronic gyroscope of the electronic device 200. The current state information includes information of a temporary pass state or information of a non-temporary pass state. In some embodiments, the current state information may define the electronic lock 100 as operating in the temporary pass state for a period of time and in the non-temporary pass state during all other time for which a temporary pass state has not been set. When the electronic lock 100 is operating in the temporary pass state, electronic device held by anyone has the correct password can unlock the electronic lock 100. When the electronic lock 100 is operating in the non-transitory pass state, only electronic devices held by privilege users have the correct password can unlock the electronic lock 100. The privilege information is identity information as to single or multiple electronic devices each held by a privilege user. In at least one embodiment, the identity information is media access control (MAC) address of an electronic device.

The obtaining module 12 receives a password transmitted from an electronic device 200.

The determining module 13 determines whether the received password matches the preset password.

If the received password matches the preset password, the determining module 13 further determines whether the electronic lock 100 is operating in the temporary pass state or in the non-temporary pass state according to the current state information. If the electronic lock 100 is operating in the temporary pass state, the control module 14 unlocks the electronic lock 100. In at least one embodiment, the control module 14 sends a message to the manager when the electronic lock 100 is unlocked, to inform the manager that the electronic lock 100 is unlocked. If the electronic lock 100 is operating in the non-temporary pass state, the obtaining module 11 obtains identity information of the electronic device 200. The determining module 13 further determines whether the obtained identity information matches the privilege information of the electronic lock 100, to determine whether the holder of the electronic device 200 is a privilege user. If the obtained identity information matches the privilege information of the electronic lock 100, the control module 14 unlocks the electronic lock 100. If the obtained identity information does not match the privilege information of the electronic lock 100, the control module 14 sends a message to the manager in order to inform the manager that someone who knows the correct password but who has no privilege is attempting to unlock the electronic lock 100.

If the received password does not match the preset password, the counting module 15 records the number of times that a wrong password is input, and the determining module 13 determines whether the number of times is greater than a preset value. If the number of times is greater than the preset value, the control module 14 sends a message to the manager and resets the number of times of wrong password input to be zero, in order to inform the manager that, although the electronic lock 100 remains locked, someone is attempting to unlock the electronic lock 100.

Figure 2:
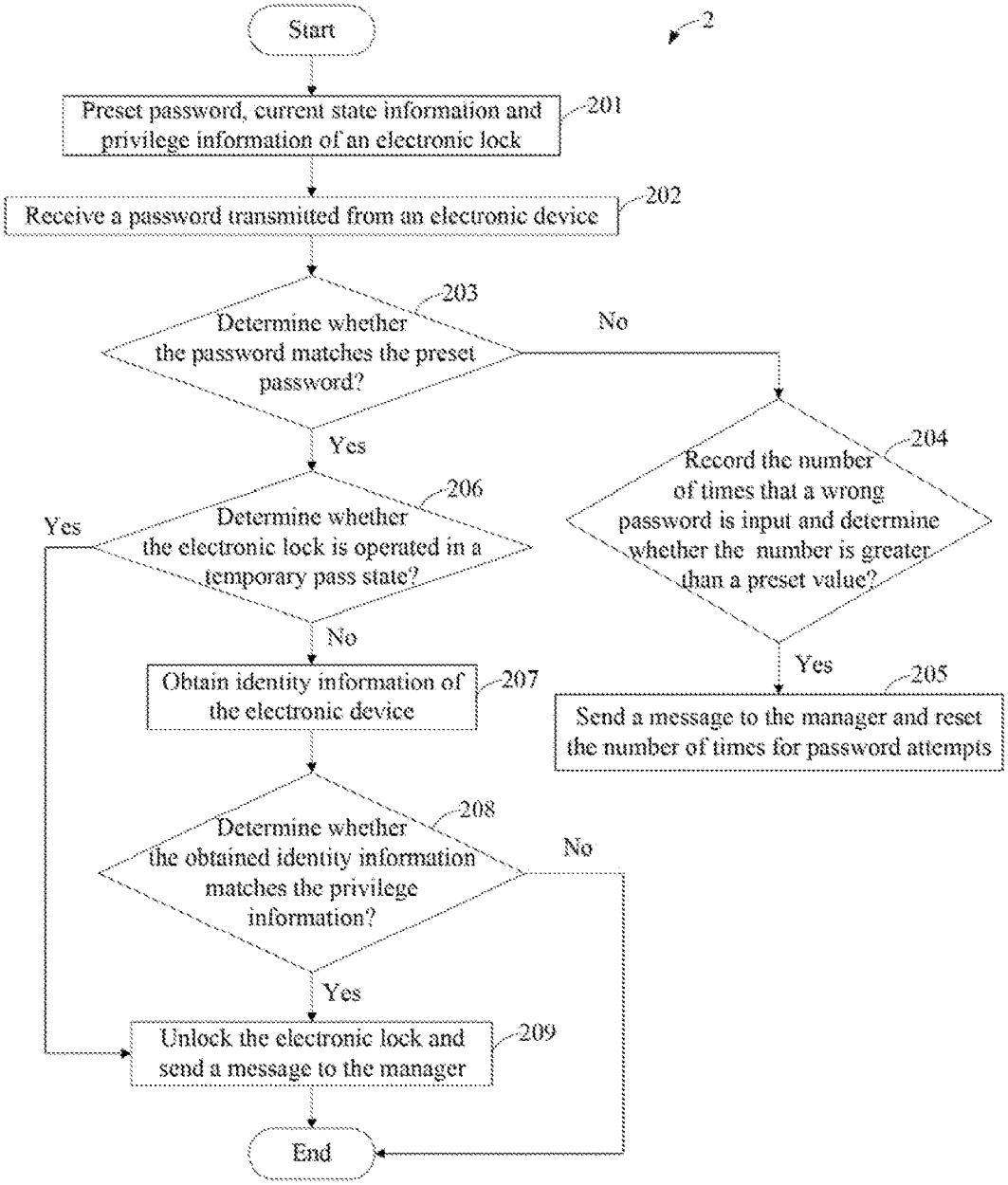
FIG. 2 illustrates a flowchart of one embodiment of a method for unlocking the electronic lock of FIG. 1.

Referring to FIG. 2, a flowchart of a method for unlocking an electronic lock is presented in accordance with an example embodiment. The example method 2 is provided by way of example, as there are a variety of ways to carry out the method. The example method 2 described below can be carried out using the configurations illustrated in FIG. 1 for example, and various elements of these figures are referenced in explaining example method 2. Each block shown in FIG. 2 represents one or more processes, methods, or subroutines carried out in the example method 2. Furthermore, the illustrated order of blocks is by example only and the order of the blocks can be changed. The example method 2 can begin at block 201. Depending on the embodiment, additional steps can be added, others removed, and the ordering of the steps can be changed.

At block 201, a setting module provides a user interface for a manager of an electronic lock to preset a preset password, current state information for the electronic lock, and privilege information of the electronic lock, to be stored in a storage device.

At block 202, an obtaining module receives a password transmitted from an electronic device.

At block 203, a determining module determines whether the received password matches the preset password. If the received password matches the preset password, block 206 is implemented. Otherwise, if the received password does not match the preset password, block 204 is implemented.

At block 204, a counting module records the number of times that a wrong password is input, and the determining module determines whether the number of times is greater than a preset value. If the recorded number of times is greater than the preset value, block 205 is implemented. Otherwise, if the number of times is not greater than the preset value, the flow ends.

At block 205, a control module sends a message to the manager and resets the number of times for password attempts to be zero.

At block 206, the determining module determines whether the electronic lock is operating in the temporary pass state or in the non-temporary pass state according to the current state information. If the electronic lock is operating in the temporary pass state, block 209 is implemented. Otherwise, if the electronic lock is operating in the non-temporary pass state, block 207 is implemented.

At block 207, the obtaining module obtains identity information of the electronic device.

At block 208, the determining module determines whether the obtained identity information matches the privilege information of the electronic lock. If the obtained identity information matches the privilege information of the electronic lock, block 209 is implemented. Otherwise, if the obtained identity information does not match the privilege information of the electronic lock, the flow ends.

At block 209, the control module unlocks the electronic lock and sends a message accordingly to the manager.

With such a configuration, the manager can set password and state information according to specific circumstances, which provides convenience for users. For example, parents can know the time their child arrives home when the child inputs the password for a locked front door. Furthermore, host can define the electronic lock as operating in a temporary pass state when he wants to have a party in his house, and can tell the invitees the password. The host need not go to the door and open it for each guest. When the party is over, the host can redefine the electronic lock as not operating in a temporary pass state.

It should be emphasized that above-described embodiment of the present disclosure including any particular embodiments, are merely examples of implementations set forth for a clear understanding of the principles of the disclosure. Many variations and modifications can be made to the above-described embodiment(s) of the disclosure without departing substantially from the spirit and principles of the disclosure. All such modifications and variations are intended to be included herein within the scope of this disclosure and protected by the following claims.

What is claimed is:

1. An electronic lock comprising:

at least one processor; and a non-transitory storage device that stores a preset password for unlocking the electronic lock, wherein the preset password is a movement of one or more electronic devices, the non-transitory storage device further stores one or more programs which, when executed by the at least one processor, cause the at least one processor to:

receive a password transmitted from an electronic device;

determine whether the received password matches the preset password;

if the received password matches the preset password, determine whether the electronic lock is operating in a temporary pass state or in a non-temporary pass state, wherein, the temporary pass state defines the electronic lock as operating for a period of time;

if the electronic lock is operating in the temporary pass state, unlock the electronic lock;

if the electronic lock is operating in the non-temporary pass state, obtain identity information of the electronic device;

determine whether the obtained identity information matches the privilege information of the electronic lock; and if the obtained identity information matches the privilege information of the electronic lock, unlock the electronic lock.

2. The electronic lock according to claim 1, wherein the at least one processor further provides a user interface for a manager to preset a current state information for the electronic lock, the preset password or the privilege information of the electronic lock, wherein the current state information comprises information of a temporary pass state or information of a non-temporary pass state.

3. The electronic lock according to claim 1, wherein the preset password is acceleration range or angle range of electronic devices, and the password is an acceleration or an angle detected by an electronic gyroscope of the electronic device.

4. The electronic lock according to claim 1, wherein the privilege information is identity information as to single or multiple electronic devices each held by a privilege user, and the identity information is media access control (MAC) addresses of an electronic device.

5. The electronic lock according to claim 1, wherein the at least one processor further:

records a number of times that a wrong password is input if the received password does not match the preset password;

determines whether the number of times is greater than a preset value; and if the number of times is greater than the preset value, sends a message to a manager of the electronic lock and resets the number of times for password attempts to be zero.

6. A computer-implemented method for unlocking an electronic lock being executed by a processor of the electronic lock, the method comprising:

receiving a password transmitted from an electronic device, wherein the password is a movement of the electronic device;

determining whether the received password matches a preset password;

if the received password matches the preset password, determining whether the electronic lock is operating in a temporary pass state or in a non-temporary pass state, wherein, the temporary pass state defines the electronic lock as operating for a period of time;

if the electronic lock is operating in the temporary pass state, unlocking the electronic lock;

if the electronic lock is operating in the non-temporary pass state, obtaining identity information of the electronic device, and;

determining whether the obtained identity information matches privilege information of the electronic lock, wherein the privilege information is pre-stored in a storage device of the electronic lock; and if the obtained identity information matches the privilege information of the electronic lock, unlocking the electronic lock.

7. The method according to claim 6, further comprising:

providing a user interface for a manager to preset a current state information for the electronic lock, the preset password or the privilege information of the electronic lock, wherein the current state information comprises information of a temporary pass state or information of a non-temporary pass state.

8. The method according to claim 6, wherein the preset password is acceleration range or angle range of electronic devices, and the password is an acceleration or an angle detected by an electronic gyroscope of the electronic device.

9. The method according to claim 6, wherein the privilege information is identity information as to single or multiple electronic devices each held by a privilege user, and the identity information is media access control (MAC) addresses of an electronic devices.

10. The method according to claim 6, further comprising:

recording the number of times that a wrong password is input if the received password does not match the preset password;

determining whether the number of times is greater than a preset value; and if a number of times is greater than the preset value, sending a message to a manager of the electronic lock and resetting the number of times for password attempts to be zero.

11. A non-transitory storage medium having stored thereon instructions that, when executed by a processor of an electronic lock, causes the processor to perform a method for unlocking the electronic lock, the method comprising:

receiving a password transmitted from an electronic device, wherein the password is a movement of the electronic device;

determining whether the received password matches a preset password;

if the received password matches the preset password, determining whether the electronic lock is operating in a temporary pass state or in a non-temporary pass state, wherein, the temporary pass state defines the electronic lock as operating for a period of time;

if the electronic lock is operating in the temporary pass state, unlocking the electronic lock;

if the electronic lock is operating in the non-temporary pass state, obtaining identity information of the electronic device;

determining whether the obtained identity information matches privilege information of the electronic lock, wherein the privilege information is pre-stored in a storage device of the electronic lock; and if the obtained identity information matches the privilege information of the electronic lock, unlocking the electronic lock.

12. The non-transitory storage medium according to claim 11, wherein the privilege information as to single or multiple electronic devices each held by a privilege user, and the identity information is media access control (MAC) addresses of an electronic devices.

13. The non-transitory storage medium according to claim 11, wherein the preset password is acceleration range or angle range of electronic devices, and the password is an acceleration or an angle detected by an electronic gyroscope of the electronic device.

14. The non-transitory storage medium according to claim 11, wherein the method further comprising:

recording the number of times that a wrong password is input if the received password does not match the preset password;

determining whether the number of times is greater than a preset value; and if a number of times is greater than the preset value, sending a message to a manager of the electronic lock and resetting the number of times for password attempts to be zero.

* * * * *